US011825273B2

(12) United States Patent
Fritzsche et al.

(10) Patent No.: US 11,825,273 B2
(45) Date of Patent: Nov. 21, 2023

(54) VIBRATION MODULE FOR PLACEMENT ON AN EARDRUM

(71) Applicant: Vibrosonic GmbH, Mannheim (DE)

(72) Inventors: Tobias Fritzsche, Ludwigshafen (DE); Daniela Wildenstein, Tübingen (DE)

(73) Assignee: Vibrosonic GmbH, Mannheim (DE)

( * ) Notice: Subject to any disclaimer, the term of this patent is extended or adjusted under 35 U.S.C. 154(b) by 155 days.

(21) Appl. No.: 17/310,396

(22) PCT Filed: Jan. 31, 2020

(86) PCT No.: PCT/EP2020/052465
§ 371 (c)(1),
(2) Date: Jul. 30, 2021

(87) PCT Pub. No.: WO2020/157296
PCT Pub. Date: Aug. 6, 2020

(65) Prior Publication Data

US 2022/0021990 A1 Jan. 20, 2022

(30) Foreign Application Priority Data

Jan. 31, 2019 (DE) ..... 10 2019 201 273.6

(51) Int. Cl.
*H04R 25/00* (2006.01)

(52) U.S. Cl.
CPC ..... *H04R 25/606* (2013.01)

(58) Field of Classification Search
CPC .... H04R 25/606; H04R 17/00; H04R 25/554; H04R 25/65
See application file for complete search history.

(56) References Cited

U.S. PATENT DOCUMENTS

| | | | | |
|---|---|---|---|---|
| 5,259,032 | A | 11/1993 | Perkins et al. | |
| 2006/0189841 | A1 | 8/2006 | Pluvinage | |
| 2010/0152527 | A1* | 6/2010 | Puria | H04R 25/656 600/25 |
| 2012/0014546 | A1 | 1/2012 | Puria et al. | |
| 2016/0323680 | A1 | 11/2016 | Dalhoff et al. | |
| 2018/0213331 | A1 | 7/2018 | Rucker et al. | |

FOREIGN PATENT DOCUMENTS

| | | | |
|---|---|---|---|
| DE | 102013114771 | A1 | 6/2015 |
| EP | 2362686 | A2 | 8/2011 |

OTHER PUBLICATIONS

"Singapore Application Serial No. 11202108230W, Written Opinion dated Jan. 9, 2023", (dated Jan. 9, 2023), 5 pgs.
"Singapore Application Serial No. 11202108230W, Search Report dated Jan. 9, 2023", (dated Jan. 9, 2023), 2 pgs.
"Indian Application Serial No. 202117034379, Office Action dated Feb. 10, 2023", (dated Feb. 10, 2023), 7 pgs.
"German Application Serial No. 10 2019 201 273.6, Office Action dated Sep. 19, 2019", (dated Sep. 19, 2019), 7 pgs.
"International Application Serial No. PCT/EP2020/052465, International Search Report dated Apr. 28, 2020", w/ English Translation, (dated Apr. 28, 2020), 5 pgs.
"International Application Serial No. PCT/EP2020/052465, Written Opinion dated Apr. 28, 2020", (dated Apr. 28, 2020), 8.

* cited by examiner

*Primary Examiner* — Amir H Etesam
(74) *Attorney, Agent, or Firm* — Schwegman Lundberg & Woessner, P.A.

(57) ABSTRACT

The invention relates to a vibration module for placing on an eardrum, which vibration module has a flat sound transducer and an eardrum contact mold for contacting the eardrum.

22 Claims, 8 Drawing Sheets

VIBRATION MODULE FOR PLACEMENT ON AN EARDRUM

PRIORITY APPLICATIONS

Figure 1:
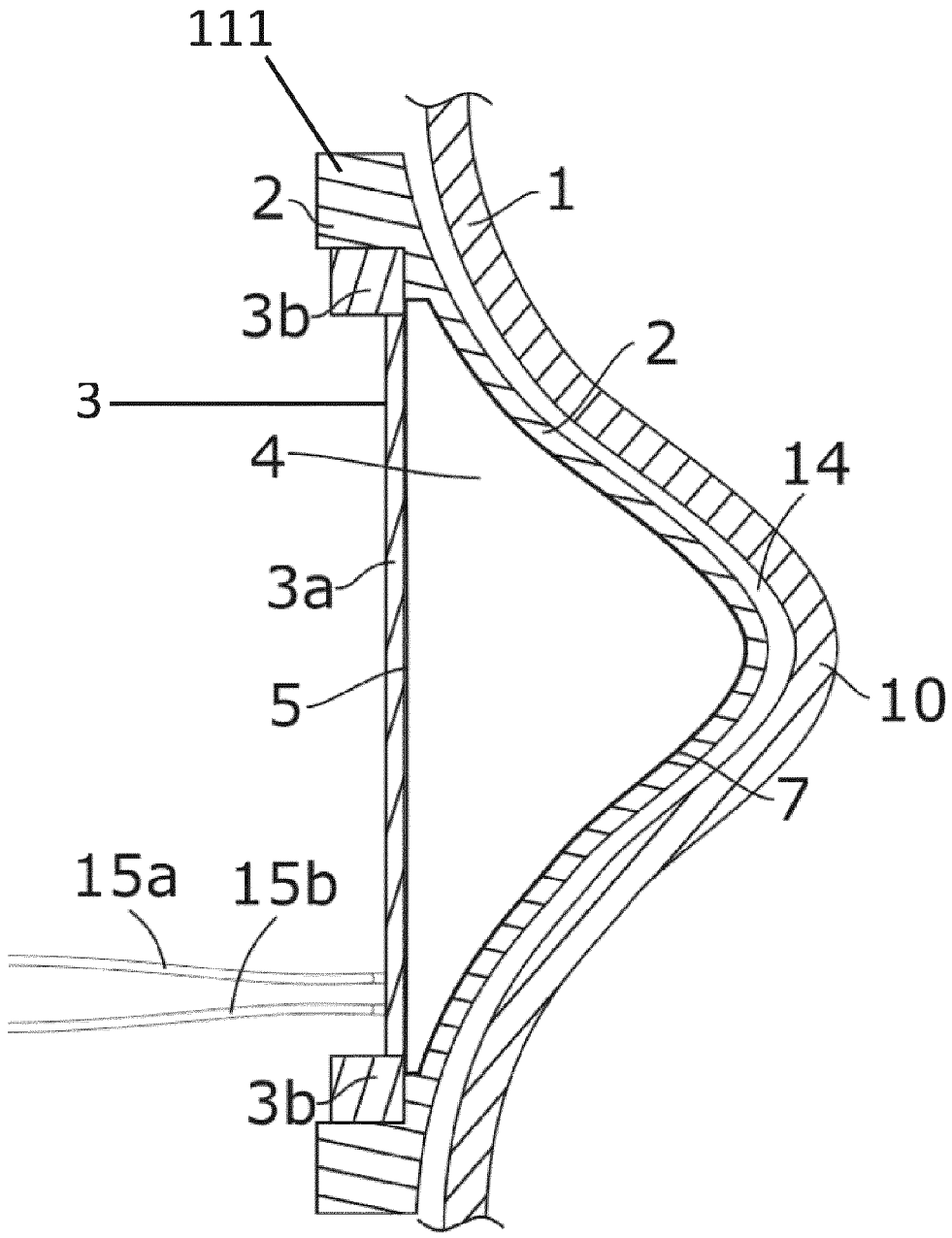

This application is a U.S. National Stage Filing under 35 U.S.C. § 371 from International Application No. PCT/EP2020/052465, filed on Jan. 31, 2020, and published as WO2020/157296 on Aug. 6, 2020, which claims the benefit of priority to German Application No. 10 2019 201 273.6, filed on Jan. 31, 2019; the benefit of priority of each of which is hereby claimed herein, and which applications and publication are hereby incorporated herein by reference in their entireties.

The invention relates to a vibration module for placement on an eardrum, which vibration module has a flat sound transducer and an eardrum contact mold for contacting the eardrum.

Conventional hearing aids transmit amplified sound to the eardrum by means of a sound transducer, also known as a loudspeaker or receiver. This sound transducer is placed in the ear canal, or it lies in a behind-the-ear housing and the sound is guided into the ear canal by means of a sound tube. The ear canal is often closed acoustically behind the sound outlet in order to avoid feedback and enable more efficient transmission. If said ear canal is left open, the transmission is inefficient, in particular in the low-frequency range, but it is more comfortable to wear since the so-called occlusion effect does not occur. The position of the sound outlet opening and the acoustic transmission of the sound to the eardrum further lead to transmission behavior that varies greatly over the frequency due to resonances in the volume of the ear canal.

These disadvantages of conventional hearing aids can be overcome in which the sound transducer stimulates the eardrum and the ossicles in the middle ear that strike it in direct mechanical contact. Airborne sound is then no longer involved, which means that the vibration is transmitted to the ear with a flat frequency response and very efficiently. The sound radiated into the ear canal is significantly reduced, which means that an open ear canal is possible without problems of feedback.

The object of the present invention is to provide a vibration module that rests directly on the eardrum and exerts a force on the eardrum and the ossicles through a flat electromechanical actuator, which leads to a vibration of the same in the audible frequency range and thus to an auditory impression.

The use of a flat sound transducer makes it possible to keep the weight of the vibration module low and to shift the center of gravity of the vibration module closer to the eardrum. Reliable fastening by means of adhesive forces only, without being supported on the ear canal, is thus possible. This enables a high level of comfort and also makes an impression of the ear canal unnecessary.

Piezoelectric layers advantageously produced in thin layer technology can optionally achieve sufficient forces and deflections in the small installation space to achieve an equivalent acoustic pressure of 120 dB SPL and more at voltages of up to 4 V. The low moving mass enables frequency-dependent transmission behavior in the audible range.

This object is achieved by the vibration module for placing on an eardrum according to claim 1 and the method for producing such a vibration module according to claim 19. The dependent claims indicate advantageous further refinements of the vibration module according to the invention.

According to the invention, a vibration module is specified which is suitable for being placed on an eardrum. Advantageously, the vibration module can be placed on the eardrum such that said vibration module does not come into contact with the wall of the ear canal or only slightly. The suitability for placing on the eardrum is thereby a proposition about the dimensions of the vibration module, which can, for example, be such that the vibration module can be placed on the eardrum of an average adult person or an average person of a given age group for whom the vibration module is intended.

A unit of components connected to one another, which are designed such that said components are supported by the eardrum when resting on the eardrum and/or are exclusively in contact with the eardrum, can be regarded as a vibration module here. Preferably, however, this exclusivity is to be understood such that contacts for the transmission of electrical energy and/or signals with other components, for example, a control component, can nevertheless be provided.

The vibration module according to the invention has a flat sound transducer and an eardrum contact mold. A flat sound transducer may thereby be understood as a sound transducer which is extended further in a surface, preferably a plane, than in a thickness direction perpendicular thereto. Advantageously, the largest extension in the planar direction can be greater than or equal to 5 times the largest extension in the thickness direction, preferably 7 times, preferably 10 times, preferably 20 times. Preferably, the surface of the sound transducer, in which said sound transducer extends flat, extends over the entire extent of the eardrum contact mold, with the exception of those areas that serve to hold the flat sound transducer and/or connect the flat sound transducer to the eardrum contact mold. The extent of the eardrum contact mold can be understood as a projection of the surface of the eardrum contact mold onto the plane in which the sound transducer extends flat. As an alternative or in addition, a flat sound transducer can also be understood as a sound transducer that executes vibrations in the direction of a normal on the surface of the sound transducer. In this case, the direction of the maximum amplitude of the vibrations of vibratory or vibrating components is preferably perpendicular to the surface in which the sound transducer extends flat.

A sound transducer can be understood here as an element which converts an electrical or optical input signal into a mechanical vibration and/or which converts mechanical vibrations into electrical or optical signals.

The vibration module according to the invention also has an eardrum contact mold for contacting the eardrum. The eardrum contact mold is designed such that it can be brought into contact with the eardrum directly or via at least one mediating layer. If one or more mediating layers are provided between the eardrum contact mold and the eardrum, said mediating layers can optionally also be regarded as part of the eardrum contact mold. The eardrum contact mold preferably has a surface which, when used as intended, faces the eardrum and which is shaped such that it follows the shape of the eardrum at least in sections.

In an advantageous embodiment of the invention, the vibration module can be designed such that the flat sound transducer and the eardrum contact mold enclose an inner volume. The fact that the flat sound transducer and the eardrum contact mold enclose the inner volume means that they enclose or surround this inner volume on all sides.

Alternatively, the flat sound transducer and the eardrum contact mold can also delimit an inner volume, preferably in all three spatial directions. A surface can therefore be arranged from the inner volume in all spatial directions which delimits the inner volume in this direction, wherein the delimitation may be complete, but does not have to be complete. Although it is possible for the flat sound transducer and the eardrum contact mold to then enclose the inner volume so that they completely surround the inner volume, it is advantageous if one or more openings or passages are provided through the flat sound transducer and/or the eardrum contact mold. This, too, should preferably be regarded as enveloping, enclosing or surrounding. The inner volume can be empty or filled with air or said inner volume can contain elements and/or other materials, for example, for the transmission of vibrations.

In an advantageous embodiment of the invention, the flat sound transducer can have a membrane structure on at least part of its surface or as at least part of its surface. This can have at least one carrier layer and at least one piezoelectric layer which is arranged on the carrier layer and has at least one piezoelectric material. The membrane structure can be designed such that the sound transducer can be excited to vibrate at least in sections by applying an electrical voltage to the piezoelectric layer.

The membrane structure may be divided in the surface by at least one cut line severing all layers of the membrane structure into at least one, two, or more segments, such that the membrane structure is mechanically decoupled at the cut lines.

In one advantageous embodiment of the invention, the sound transducer may have a membrane structure which has at least one carrier layer and at least one piezoelectric layer having at least one piezoelectric material arranged on the carrier layer. The at least one carrier layer and the at least one piezoelectric layer thus form a layer system in which the carrier layer and the piezoelectric layer are arranged parallel on top of one another. In this embodiment, vibrations of the membrane structure may be generated by applying a voltage to the piezoelectric layer, in particular an alternating voltage. This utilizes the fact that the piezoelectric layer deforms when the voltage is applied, wherein the direction of the deformation depends on the sign of the applied voltage. A membrane structure may herein be understood as a structure which extends substantially flat, which has a significantly higher extension in two dimensions than in the dimension perpendicular to the two dimensions. The two dimensions, in which the membrane structure primarily extends, thereby span a membrane surface and the surface of the sound transducer.

The membrane structure of the sound transducer may be divided by at least one cut line in its flat extension into at least one, two, or more segments. Dividing the membrane surface means that the entire membrane, thus both the carrier layer and also the piezoelectric layers, and, if necessary, electrode layers, are divided by mutual cut lines, such that the membrane is mechanically decoupled at the cut line(s), which means that two areas of the membrane structure, separated by a cut line, are movable independently of one another. The division or segmentation of the membrane surface thus means a corresponding segmentation of the carrier layer and corresponding segmentation, if necessary, of the piezoelectric layer and, if necessary, electrode layers.

The segmentation enables a high amplitude of a vibration at very small installation size without the force becoming too low due to these measures.

Sound vibrations are understood in the meaning of the application to be vibrations with frequencies that can be perceived by the human ear, i.e., vibrations between approx. 20 Hz and 20,000. The sound vibrations are additionally suited for exciting sound waves in a medium, in particular air or perilymph.

The membrane structure advantageously has at least one carrier layer and at least one piezoelectric layer, which has at least one piezoelectric material, arranged on the carrier layer. The carrier layer and the piezoelectric layer then form a bimorph structure and are therefore advantageously arranged and designed so that the membrane structure is oscillatable by applying a voltage, in particular an alternating voltage, to the piezoelectric layer, and/or voltages in the piezoelectric layer generated by vibrations of the membrane are detectable. The carrier layer and the piezoelectric layer may hereby be arranged with parallel layers planes on top of one another or on one another and should be directly or indirectly connected to one another. The aforementioned cut lines preferably sever all layers of the membrane structure.

In order to guarantee good audiological quality, the membrane structure is advantageously designed so that, when the vibration module is placed as intended on the eardrum on the umbo, it enables a maximum deflection from 0.01 to 5 μm, preferably of 5 μm. A mechanical rigidity at the umbo of approx. 1200 N/m (valid up to approx. 1 kHz) is thereby preferably overcome. In this case, the force required for 5 μm is approx. 6 mN. At higher frequencies, the rigidity increases, but the hearing is at the same time more sensitive, so that the required deflection decreases.

The segments may be configured so that the impedance is optimal, in particular with respect to their length.

It is particularly preferred that the membrane structure is carried out in thin layer technology. Thin layers are advantageous, as high fields are required to generate high energy densities; whereas the applied voltages are to be as low as possible because of the biological surroundings. The necessary energy densities are achievable in a thin layer membrane.

In particular, the piezoelectric layers according to the invention may thereby be produced in thin layer technology. To produce a piezoelectric layer of the membrane structure, piezoelectric material is applied in the thickness of the piezoelectric layer. The application may be carried out using deposition techniques, like physical vapor deposition, chemical vapor deposition, sol-gel process and others.

The piezoelectric layers preferably have a thickness of ≤20 μm, preferably ≤10 μm, particularly preferably ≤5 μm and/or ≥0.2 μm, preferably ≥1 μm, preferably ≥1.5 μm, particularly preferably =2 μm. The electrode layers advantageously have a thickness of ≤0.5 μm, advantageously ≤0.2 μm, particularly preferably ≤0.1 μm and/or ≥0.02 μm, advantageously ≥0.05 μm, and particularly preferably ≥0.08 μm.

Thin layers of the sound transducer—both the silicon beam structure and also the piezoelectric layer(s)—ensure that only a small mass is set into movement by the deflection of the beams. The resonance frequency of the vibration system for the described actuator variants is located in the upper range of the frequency bandwidth of human hearing. Thus, a uniform excitation of the round window across the entire human frequency range is possible when the vibration module is placed on the eardrum as intended.

The generation of the mechanical vibrations of the sound transducer according to the invention is thereby based on the principle of elastic deformation of a bending beam, wherein the membrane or segments of the membrane may be considered to be bending beams. The piezoelectric layer is able to be shortened or lengthened by applying the voltage and the electrical field generated thereby. Mechanical stresses are hereby generated in the material composite made of the carrier layer and piezoelectric layer, which lead to an upward bending of the beams or the membrane structure in a shortening piezoelectric layer and to a corresponding downward movement in the case of a lengthening piezoelectric layer. Whether the piezoelectric layer lengthens or shortens depends on the polarization direction of the piezoelectric layer and the direction of the applied voltage or the applied electrical field.

In the case of a single-layer sound transducer, the described carrier layer may carry a single layer of piezoelectric material. In addition, the electrodes form further components of the layer structure. A bottom electrode may thereby be applied directly or via a barrier layer onto the silicon substrate, whereas in contrast, a top electrode may be located on top of the piezoelectric layer. The polarization direction of the piezoelectric material is preferably perpendicular to the surface of the silicon structure. If an electric voltage is now applied between the top and bottom electrodes and an electrical field forms, then the piezoelectric material shortens or lengthens (depending on the sign of the voltage) in the beam longitudinal direction due to the transversal piezoelectric effect, mechanical stresses are generated in the layer composite, and the beam structure undergoes a bending.

It is preferred if the membrane structure has a circular or oval periphery. In particular, it is favorable if the periphery of the membrane structure corresponds to the periphery of the eardrum of an ear, such that the peripheral line of the membrane structure runs approximately parallel to the periphery of the eardrum when the sound transducer is placed. An n-cornered periphery of the membrane structure, where n is preferably ≥6, is possible.

In particular in the case of a circular periphery, however also for other shapes of the membrane structure, it is further preferred if the cut lines, which divide the membrane surface into segments, run radially from an edge of the membrane structure in the direction of a center point of the membrane. The cut lines do not have to start directly at the edge and do not have to reach the center point; it is also sufficient if the cut lines run from the vicinity of the edge up to the vicinity of the center point. If, however, the cut lines do not reach the center point, then a free area, in which the cut lines end, should be present in the center point, such that the mechanical decoupling of the segments is guaranteed at that end facing the center point.

The segments may be hereby configured so that they are pie wedge shaped; thus, having two edges as side edges running in an angle to one another and an outer edge which runs on the periphery of the membrane structure parallel to this periphery. At the other end of the side edges, opposite the outer edge, the segments may run together into a point or be cut so that a free area results around the center point. At the edge, the segments may then be permanently arranged on the edge of the membrane structure and be independent of one another at the side edges and, if necessary, at that edge facing the center point, such that they may vibrate freely about the outer edge. The largest deflection will hereby normally occur at that edge of the segment facing the center point. The number of segments is preferably 6, particularly preferably 8.

The cut lines may run radially straight, such that the segments have straight radial edges.

However, it is also possible that the radially-extending cut lines extend in a curve, such that segments result without straight, radially-extending edges. In particular, segments may thus be formed which extend in the radial direction in an arch shape, wave shape, or along a zigzag line. Numerous other geometries are also conceivable.

In one alternative embodiment of the invention, the membrane structure may be structured by at least one spiral-shaped cut line. The at least one cut line thereby runs so that at least one spiral-shaped segment results, which preferably winds about a center point of the membrane structure. It is also possible to provide multiple cut lines, which divide the membrane structure so that two or more spiral-shaped segments result, which advantageously respectively wind about the center point of the membrane structure and particularly preferably run into one another.

In order to oscillate the membrane structure and/or in order to tap a voltage at the piezoelectric layer, at least one first and at least one second electrode layer are arranged on the on the membrane structure, wherein the at least one piezoelectric layer is arranged between the first and the second electrode layer. The electrode layers hereby preferably cover the piezoelectric layer and are arranged with parallel layer planes on or on top of the piezoelectric layer. The first or second electrode layer is preferably arranged between the carrier layer and the piezoelectric layer, such that the piezoelectric layer is arranged over one of the electrode layers on top of the carrier layer. The piezoelectric layer and the electrode layers particularly preferably completely cover one another.

The use of segment structures enables a higher deflection, in contrast to an unstructured membrane, as the beam elements may freely deform where they are separated by the cut lines, e.g., in the center of the disk, and thus undergo a constant bending in only one direction. In contrast, the deformation of a coherent membrane is characterized by a change of direction of the curvature, which leads to smaller deflections.

In one preferred embodiment, the membrane structure has a plurality of piezoelectric layers arranged with parallel surfaces on top of one another, wherein an electrode layer is arranged between each two adjacent piezoelectric layers. An electrode layer and a piezoelectric layer are thus respectively arranged alternating on the carrier layer. Electrode layers and piezoelectric layers may be arranged directly on top of one another, connected to one another, or arranged on top of one another via one or more intermediate layers. Vibrations with a particularly large force or power may be generated and vibrations may be detected particularly precisely with this embodiment.

Electrodes with different electrical potential alternate with piezoelectric layers in the layer structure in this transducer modification. The silicon structure is initially followed by a bottom electrode, followed by a first piezoelectric layer, an electrode with opposite potential, a second piezoelectric layer, an electrode with the potential of the bottom electrode, etc.

The polarization direction of the individual piezoelectric layers may be perpendicular to the surface of the membrane structure, as is the case in the single-layer transducer; however, it faces in the opposite direction for alternating piezoelectric layers. The electrical field building up between the electrodes of opposite potentials and the polarization direction alternating for the individual piezoelectric layers ensures a mutual change in length of the entire layer structure, which in turn causes the silicon structure to bend.

The electrode layers are advantageously configured or contacted so that a charge with a different polarity may be applied to each two adjacent electrode layers. By this means, an electrical field may be generated in the piezoelectric layers which extends in each case from one electrode layer to the adjacent electrode layer. In this way, the piezoelectric layers may be penetrated particularly uniformly with electrical fields. In the case of a vibration detection, different signs of a voltage arising at the piezoelectric layer may preferably be tapped in each case by adjacent electrode layers.

In another advantageous embodiment of the present invention, at least two strip-shaped, thus elongated electrodes, which form an electrode pair, are arranged on the surface of the at least one piezoelectric layer or on the surface of the carrier layer so that they extend parallel to the corresponding surface and preferably also extend parallel to one another. A charge with a different polarity is able to be respectively applied to the two electrodes of an electrode pair such that an electrical field forms between the electrodes of an electrode pair and penetrates the piezoelectric layer at least in sections. If multiple electrode pairs are provided, an electrode field may also form between electrodes of different polarities of adjacent electrode pairs and penetrate the piezoelectric layer. In the case of vibration detection, an electrical voltage is able to be tapped or detected by the electrode pair.

The strip conductor structures of the strip-shaped electrodes may preferably have a rectangular cross section.

It is particularly advantageous if a plurality of electrode pairs, each comprising two electrodes to which different polarities are able to be applied, are arranged so that the electrodes of the plurality of electrode pairs extend parallel to one another. The electrode pairs should thereby be additionally arranged so that charges of different polarity are able to be applied to two adjacently-extending electrodes. In this way, an electrical field, penetrating the piezoelectric layer, forms between each two adjacent electrodes. In the case that, as described here, a plurality of electrode pairs is provided, then a plurality of electrodes is present on one surface of the piezoelectric layer or of the carrier layer and may extend parallel to one another and may be arranged adjacent to one another with alternating polarity.

The polarity of the piezoelectric material is not distributed homogeneously across the entire piezoelectric layer in the case; instead, the polarization direction extends from the negative to the positive electrode forming line-shaped fields. During operation of the transducer, when an alternating electrical potential is applied to the comb-shaped electrodes, then an electrical field forms along the polarization direction of the piezoelectric material, along which field the piezoelectric material extends or shortens. By this means, the entire piezoelectric layer lengthens or shortens in the beam longitudinal direction, which leads to an upward bending or downward bending of the silicon structure.

It is particularly advantageous if the electrodes additionally extend parallel to the edge of the membrane structure in this case. If the membrane structure is circular, then the electrodes preferably form concentric circles about the center point of the membrane structure. Correspondingly, the electrodes are also preferably configured to be oval in the case of an oval membrane structure. The electrodes may each extend along the entire periphery parallel to the periphery of the membrane structure, or only on a part of the periphery, such that they have, for example, the shape of circular arc sections.

Strip-shaped electrodes may be particularly advantageously contacted via mutual conductors, wherein a plurality of electrodes may be contacted by one mutual conductor. Thus, a plurality of electrodes of one polarity may be connected to at least one first conductor and electrodes of the other polarity may be connected to at least one second conductor. In order that the electrodes of different polarities are arranged alternatingly, the electrodes of different polarities assigned to the different conductors may mesh into one another in a comb shape. The mutual conductors may hereby cut the electrodes of their corresponding polarity and extend, e.g., preferably radially in the case of circular electrodes.

In the case of a strip-shaped embodiment of the electrodes, the membrane structure may also be designed as multilayered. It is again possible that multiple piezoelectric layers are arranged on top of one another, wherein strip-shaped electrodes may then extend between two respectively adjacent piezoelectric layers. The arrangement of electrodes hereby corresponds to the arrangement on the surface of a piezoelectric layer described above. However, it is also possible that the membrane structure has at least one piezoelectric layer which is penetrated by strip-shaped electrodes or electrode pairs in one or more planes. In this case, the electrodes of the electrode pairs extend in the interior of the corresponding piezoelectric layer. The different possibilities for the arrangement also correspond here to that of the abovementioned arrangement on the surface of the piezoelectric layer.

This variant of the sound transducer has a thicker piezoelectric layer, which, in contrast to the previous solution, may be penetrated by multiple layers of comb-shaped electrodes. The polarization in the piezoelectric material runs again from the negative to the positive strip conductor electrode forming line-shaped fields. Upon applying a voltage, an electrical field forms along the polarization direction which leads to an extension or shortening of the piezoelectric material along the field lines and to a downward bending or upward bending of the beam structure.

In the case of spiral-shaped segments, strip-shaped electrodes may be arranged along the longitudinal direction of the segments. One electrode pair is preferably sufficient in this case.

The effectiveness and linearity of the piezoelectric transducer can be increased by applying a direct voltage to the actuator electrodes, on which the alternating voltage, which is material to the acoustic vibration, is superimposed. This increases the polarization of the piezoelectric material, as a result of which a smaller change in voltage causes a greater change in force or deflection.

Since the sound transducer is used in a possibly moist biological environment, it is advantageous if the voltage, particularly the direct voltage, which is applied to the electrodes, is less than 5 volts, preferably less than 4.3 volts, particularly preferably less than 1.3 volts. Alternatively or additionally, it is also possible to encapsulate the electrodes to be liquid tight and/or electrically insulated, such that said electrodes do not come into contact with an optional fluid surrounding the sound transducer or to replace the transducer regularly if it fails due to corrosion.

Since the piezoelectric effect in the relevant area is proportional to the strength of the electrical field which penetrates the material, high fields (the electrical field is calculated in the homogeneous case as the quotient of the applied voltage and the distance of the electrodes) may be generated by using very thin piezoelectric layers at very small distances of the electrodes, so that the piezoelectric effect is sufficient to achieve the vibration deflections and forces necessary for the excitation of the eardrum when the vibration module is placed as intended on the eardrum.

The carrier layer may have or comprise silicon. Suitable piezoelectric materials include, among others, PbZrxTi1−xO3, where preferably 0.45<x<0.59, particularly preferably with dopants of, for example, La, Mg, Nb, Ta, Sr and the like, preferably at concentrations between 0.1 and 10%. Additional solid solutions comprising PbTiO3, for example Pb(Mg⅓, Nb⅔)O3, Pb(Sn⅓Nb⅔)O3 are also suitable. Possible materials are also lead-free materials which contain KNbO3, NaNbO3, dopants with Li, Ta, etc., bi-containing piezoelectric layers, aurivilius phases comprising Ti, Ta, Nb, additionally also perovskite phases, like BiFe3. Conventional thin layer materials, like AlN and ZnO, are also possible.

Silicon as a carrier material for the piezoelectric layers enables the production of the disk-shaped structure and the pie wedge shaped bending beams using the structuring techniques of microsystem technology. Known and proven coating and etching methods may be used for producing beams, electrodes and the piezoelectric layer, e.g., sol-gel techniques, sputtering methods, chemical etching, ion etching, etc. Furthermore, the methods of microsystem technology allow parallelization in the manufacturing process: a plurality of sound transducers may be produced from one silicon wafer in one pass through a manufacturing process. This enables cost efficient production.

The at least one piezoelectric layer advantageously has a thickness of ≤20 μm, advantageously ≤10 μm, particularly preferably ≤5 μm and/or ≥0.2 μm, advantageously ≥1 μm, preferably ≥1.5 μm, particularly preferably =2 μm. The electrode layers each advantageously have a thickness of ≤0.5 μm, advantageously ≤0.2 μm, particularly preferably ≤0.1 μm and/or ≥0.02 μm, advantageously ≥0.05 μm, particularly preferably ≥0.08 μm. A diameter of the membrane structure is advantageously ≤4 mm, preferably ≤3 mm, particularly preferably ≤2 mm and/or ≥0.2 mm, advantageously ≥0.5 mm, preferably ≥1 mm, particularly preferably =1.5 mm. A layer thickness of 0.7 μm has also proven particularly favorable.

According to the invention, the sound transducer may also have a plurality of the membrane structures described above. These membrane structures are thereby identically structured and arranged above one another and parallel to one another so that identical segments of the structure or the cut lines of the membrane structures lie over one another. Identical segments may then be coupled to one another so that a deflection and/or application of force of one of the segments transmits to the adjacent segments. The membrane structures may thereby be arranged above one another so that, upon applying a voltage of a defined polarity to the sound transducer, all segments are deflected in the same direction. The membrane structures are hereby identically oriented. In this case, a total force may be realized which is higher than that of a single membrane structure. It is also possible to arrange the membrane structures on top of one another so that adjacent membrane structures are respectively oriented in opposite directions, such that, upon applying a voltage of a defined polarity, adjacent membrane structures respectively deflect in different directions. In this case, a total deflection may be realized which is greater than that of a single membrane structure.

The membrane structure may preferably be divided in the surface of the membrane structure by at least one cut line severing all layers of the membrane structure into at least one, two, or more segments, such that the membrane structure is mechanically decoupled at the cut lines. The membrane structure being mechanically decoupled at the cut lines thereby means that, a movement of the membrane structure on one side of the cut line does not cause any, or only a very small movement of the membrane structure on the opposite side of the cut line, which would be caused in the case that a force acts across the cut line. If the membrane structure is divided into two or more segments, then these may be formed, for example, by radially extending cut lines. In this case, for example, the membrane structure may itself have a circular periphery in the plane of the membrane structure, and the cut lines extend radially to this center point. All cut lines are thereby preferably mechanically decoupled in the center point.

If the membrane structure has only one cut line, then this may particularly advantageously extend in a spiral shape. The membrane structure in this case may also advantageously have a circular periphery.

The eardrum contact mold is preferably connected at its edge to the edge of the flat sound transducer, at least in sections. The connection can be direct or via one or more further components, wherein, however, a direct connection is preferred. It is particularly preferred if the flat sound transducer is connected to the eardrum contact mold over its entire periphery. The flat sound transducer and the eardrum contact mold can preferably have the same peripheral shape, so that the membrane structure and the eardrum contact mold can be connected to one another over their entire edge.

In an advantageous embodiment, the flat sound transducer can have a membrane or the membrane structure described, and also a rigid edge surrounding the membrane or the membrane structure. The edge can preferably run along the surface of the eardrum contact mold, which is oriented in the direction of the ear canal when the vibration module is placed as intended on the eardrum and/or is delimited by this surface. However, the edge can advantageously have a thickness greater than the membrane or membrane structure.

The eardrum contact mold can then be connected to the rigid edge of the flat sound transducer on at least part of the edge of the flat sound transducer, preferably over the entire length of this edge.

As described, it is advantageous if the vibration module can rest completely on the eardrum without, or only to a small extent, being supported on the wall of the ear canal. For this purpose, it is preferred if the flat sound transducer and/or the eardrum contact mold have a smallest diameter less than the smallest diameter of the eardrum and/or the flat sound transducer and/or the eardrum contact have a largest diameter less than the largest diameter of the eardrum. In this way, by suitably aligning the vibration module, this vibration module can rest completely on the eardrum without touching the edge of the eardrum. Preferably, these dimensions can be individually adapted to the dimensions of the eardrum of that person's ear in which the vibration module is to be worn. However, it is also possible to adapt these dimensions to the average dimensions of eardrums of people of a corresponding age group or group of people categorized differently. Advantageously, for example, the largest diameter of the flat sound transducer and/or the eardrum contact mold can be less than or equal to 12 mm, particularly preferably less than or equal to 10 mm, particularly preferably less than or equal to 9 mm, particularly preferably less than or equal to 7 mm. In addition, the smallest diameter of the flat sound transducer and/or the drum contact shape can advantageously be greater than or equal to 3 mm, preferably greater than or equal to 5 mm.

In an advantageous embodiment of the invention, the vibration module can have a vibration transmission element with which vibrations of the flat sound transducer can be transmitted to the eardrum contact mold. The vibration transmission element can thereby advantageously, on the one hand, be connected to or lie against the flat sound transducer and, on the other hand, be connected to or lie against the eardrum contact mold. In particular, the vibration transmission element can be connected to or lie against the flat sound transducer at one position on its surface and be connected to or lie against the eardrum contact mold at a further opposite position of its surface. In this embodiment of the invention, the vibration transmission element is particularly preferably connected to or lies against a position of the flat sound transducer that experiences a maximum deflection when a voltage is applied to the sound transducer or when the sound transducer is exposed to an acoustic vibration. Such a vibration transmission element can improve the transmission of vibrations generated by the sound transducer to the eardrum contact mold and thus to the eardrum. The vibration transmission element can partially or completely fill the inner volume.

In an advantageous embodiment of the invention, the inner volume can be partially or completely filled with a compressible or elastic or also with incompressible vibration transmission material. The transmission of the vibrations generated by the flat sound transducer to the eardrum contact mold can thereby also be improved.

The following solutions using the vibration transmission element and/or the vibration transmission material are particularly advantageous. A vibration transmission element can advantageously be provided in the inner volume, which is surrounded by air in the inner volume. The vibration transmission element here does not completely fill the inner volume and part of the inner volume is filled with air.

An embodiment is also advantageous in which a vibration transmission element is provided in the inner volume together with a compressible material, for example, silicone foam. In this case, the vibration transmission element fills part of the inner volume and the compressible material fills the remaining inner volume.

An embodiment is also possible in which a vibration transmission element is used together with an incompressible material. In this case, an equalization opening, which is described below, is preferably provided, through which the incompressible material can be displaced.

An embodiment is also advantageous in which the inner volume is completely filled with incompressible vibration transmission material and no separate vibration transmission element is provided. Here, too, the opening described below can be advantageous, in particular if the eardrum offers less resistance to the vibration transmission material than the opening. The modulus of elasticity of the material should not be too small, i.e., the material should not be too soft. The specific size depends in particular on the size of the opening.

If the flat sound transducer and the eardrum contact mold, as described, enclose an inner volume, and if the inner volume is also partially or completely filled with a vibration transmission material, it is advantageous if the flat sound transducer has a recess or opening and/or if the surface of the eardrum contact mold has a recess or opening in its surface. The opening or recess is thereby arranged such that the vibration transmission material can be displaced into it. This is because the volume displaced by the sound transducer does not naturally correspond to the volume swept over by the eardrum or the eardrum contact mold when the deflection of a location on the eardrum or the eardrum contact mold is forced to a location on the actuator surface by the vibration transmission element. An additional constraint would be introduced which would impede the movement and place an additional load on the sound transducer. The equalization opening ensures that the deflection of the flat sound transducer during vibration is not hindered by the vibration transmission material. The recess or opening, or the recess can be provided in the interior of the surface of the flat sound transducer or the eardrum contact mold or on its wall, so that the opening or the recess is delimited on part of its periphery by the flat sound transducer or the eardrum contact mold and on a further part of its periphery through the edge of the flat sound transducer or the eardrum contact mold. In other words, in this case, the inner volume is enclosed by the eardrum contact mold, the sound transducer and the opening or recess.

In an advantageous embodiment of the invention, a vibration transmission element can also be formed in the inner volume as a partial area of a vibration transmission material. In this case, for example, the vibration transmission material can completely fill the inner volume, but have a different rigidity at different locations. The vibration transmission element can then be designed as an area of increased rigidity of this material. The rigidity of this area can preferably be greater than or equal to 1,000 N/m, particularly preferably greater than or equal to 10 kN/m, particularly preferably greater than or equal to 100 kN/m.

If a compressible material is provided, it is preferred if it has a very much lower modulus of elasticity than the tappet or the material having increased rigidity, preferably by more than a factor of 10, particularly preferably more than a factor of 100.

For example, an embodiment as follows can be advantageous. The rigidity of the umbo is around 1,200 N/m. The vibration transmission element should then advantageously be just as stiff, particularly preferably stiffer. With ten times the rigidity of the umbo, there is a loss of vibration energy, which is transmitted from the sound transducer to the umbo, of about 1 dB, with a hundred times the rigidity of 0.1 dB. The greater the rigidity of the vibration transmission element, the lower the losses.

Acrylic resin, for example, is suitable as the material for the vibration transmission element. This has a modulus of elasticity of, for example, 1,300 e6 Pa. With typical dimensions, this results in a rigidity of 1.3 e6 N/m, which is orders of magnitude higher than the rigidity of the umbo.

In a preferred embodiment of the invention, the vibration transmission element can run from a location of maximum deflection of the flat sound transducer to a location of the eardrum contact mold which, when the vibration module is arranged as intended on the eardrum at a distance of less than 5 mm, is preferably less than 2 mm away from the umbo and/or away from the maleus. The distance between the respective edges of the vibration transmission element and the umbo or maleus can be regarded as the distance. The distance is then the smallest distance between these edges.

The vibration transmission element can advantageously have a length in the direction perpendicular to the surface of the flat sound transducer of greater than or equal to 0.5 mm, preferably greater than or equal to 1.5 mm and/or less than or equal to 4 mm, preferably less than or equal to 3 mm. The vibration transmission element can advantageously have a smaller diameter than the sound transducer on its side adjoining the sound transducer, wherein the diameter is preferably less than or equal to 2 mm and/or greater than or equal to 0.5 mm. Advantageously, a cross section of the vibration transmission element can widen in a plane perpendicular to the longitudinal direction of the vibration transmission element in the direction of the eardrum contact mold, so that a larger contact area is achieved between the vibration transmission element and the eardrum contact mold.

Advantageously, the eardrum contact mold has a surface facing away from the flat sound transducer, the shape of which surface corresponds to the shape of a surface of the eardrum facing the ear canal or runs at least in sections or completely parallel to this when the eardrum contact mold is arranged as intended on the eardrum. The eardrum contact mold can also be designed such that it adapts to this surface of the eardrum when it is placed thereon. Which variant is chosen here can depend on the material of the eardrum contact mold. If the material is inflexible but easy to model, the corresponding surface of the eardrum contact mold can be modeled accordingly before insertion into the ear, so that this surface rests partially or completely on the eardrum when the vibration module is inserted into the ear. If, on the other hand, the material is flexible, preceding modeling may not be necessary, since this surface adapts to the eardrum contact mold when it is placed on the eardrum's surface. An embodiment is also possible in which said surface of the eardrum contact mold follows the surface of the eardrum up to a maximum level of detail, and a material is applied to the surface of the eardrum contact mold which adapts to the eardrum when the vibration module is placed on it, or in which the eardrum contact mold itself compensates for the remaining deviation by changing shape.

An embodiment is also advantageous in which the eardrum contact mold in an area that lies against the eardrum when used as intended has a thickness that is so small that it can substantially only form tensions in directions parallel to the surface of the eardrum contact mold in this area. In this case, the eardrum contact mold behaves like a film in this area. The thickness of the eardrum contact mold in this area is preferably less than or equal to 500 μm, preferably less than or equal to 200 μm, particularly preferably less than or equal to 150 μm.

In an advantageous embodiment, the eardrum contact mold can comprise or consist of silicone.

In a preferred embodiment of the invention, the vibration module can have a layer resting on that surface of the eardrum contact mold facing away from the sound transducer, which layer is designed to improve adhesion of the eardrum contact mold to the eardrum. Such a layer can, for example, comprise or consist of white oil, fat, silicone oil, glycerine and/or paraffin. In this way, a good fit of the vibration module on the eardrum with simultaneous good vibration transmission is guaranteed.

A minimum distance between the flat sound transducer and a surface of the eardrum contact mold facing away from the sound transducer is advantageously less than or equal to 2 mm, particularly preferably less than or equal to 1 mm, particularly preferably less than or equal to 400 μm, particularly preferably less than or equal to 200 μm.

It can be advantageous if the eardrum contact mold has a convex shape in the direction of the eardrum, which convex shape maps the shape of the eardrum such that, when the vibration module is arranged as intended on the eardrum, a thin gap between 15 and 100 μm in width is created between the eardrum contact mold and the surface of the eardrum facing the ear canal. When used as intended, this can be filled with a naturally available liquid or with an additionally introduced liquid, for example, white oil. For this purpose, the eardrum contact mold could have a shape with a corresponding undersize.

In an advantageous embodiment of the invention, the flat sound transducer can be cast into the eardrum contact mold at its edge or be glued into a recess in the eardrum contact mold. In this way, the flat sound transducer can thus be inserted into the eardrum contact mold, so that, in particular, an outer edge of the vibration module can be determined by the eardrum contact mold. In this case, the largest dimension of the vibration module in the plane of the sound transducer is determined by the dimension of the eardrum contact mold in this plane. The recess in the eardrum contact mold into which the flat sound transducer is inserted can preferably run or surround the edge of the eardrum contact mold.

Preferably, the flat sound transducer can be monolithic in form, i.e., formed from a basic structure made of a single material, into which the sound transducer is formed by removing material and/or adding firmly adhering material, wherein all movable elements are implemented by solid body joints. In particular, it can be advantageous that when the monolithic sound transducer is designed, the added materials are different from those from which the basic structure is formed.

In order to simplify an orientation of the vibration module on the eardrum, a marking can advantageously be applied to the vibration module, which marking enables its angular alignment about an axis perpendicular to the sound transducer. Advantageously, the marking can be provided such that, when arranged as intended, it runs parallel to the maleus or to the longitudinal axis of the body or at a defined angle thereto. The marking should preferably be applied such that it is visible when looking at the sound transducer, so that it can be recognized when the vibration module is arranged on the eardrum. It is also possible to use as a marking a cable that is attached to the sound transducer and led away from it at a certain angle.

Additionally, a method according to the invention is specified for producing a vibration module as described above. The flat sound transducer and the eardrum contact mold are thereby produced.

Preferably, in a first step, a geometry of an eardrum surface can be recorded, a lowest point and/or a position of the maleus can be determined in the recorded geometry, a negative shape can be made from the recorded geometry and the eardrum contact mold can be made by means of this negative shape. The creation of a negative shape is not essential, since the silicone mold can also be produced directly from silicone, for example, in a 3D printing process.

In the following, the invention will be described by way of example based on a few figures. Identical reference numbers thereby designate identical or corresponding features. The features described in the examples may also be realized independently from the specific example and may be combined between different examples.

In the drawings

Figure 2:
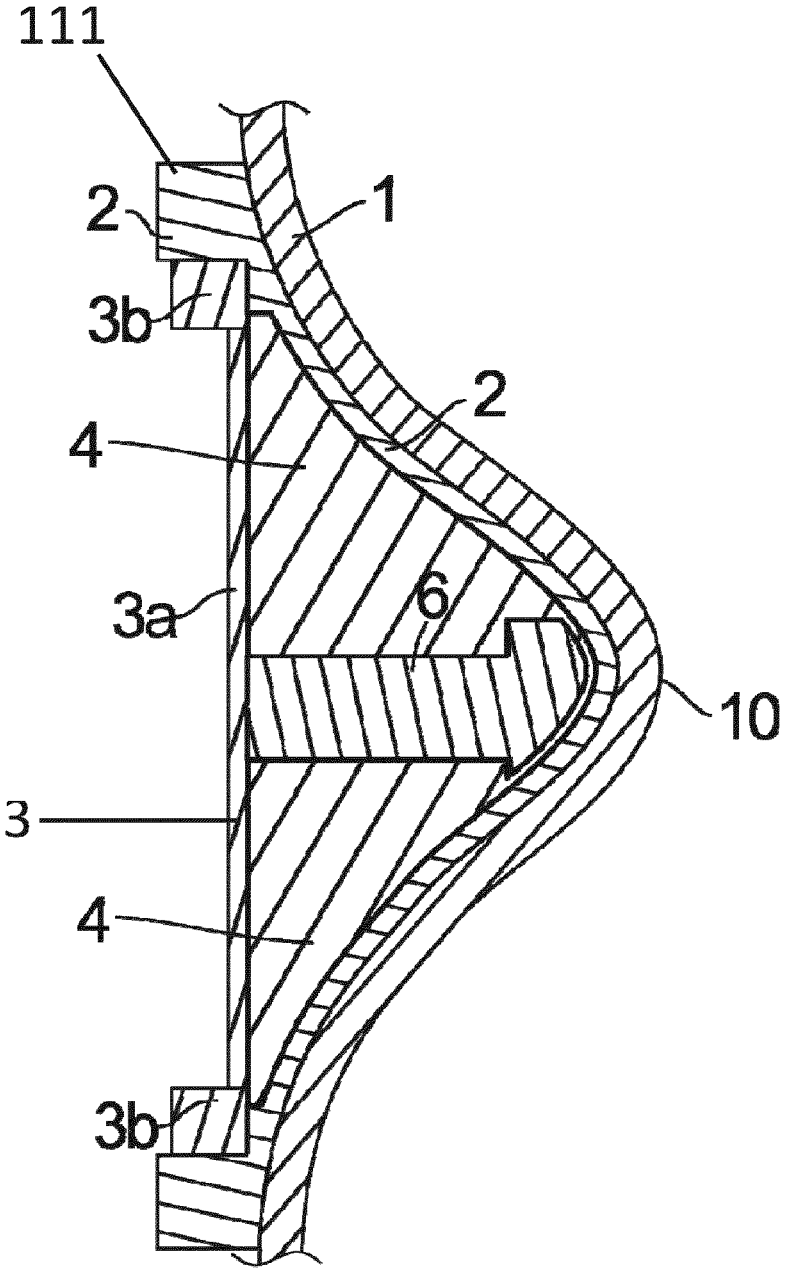
Figure 3:
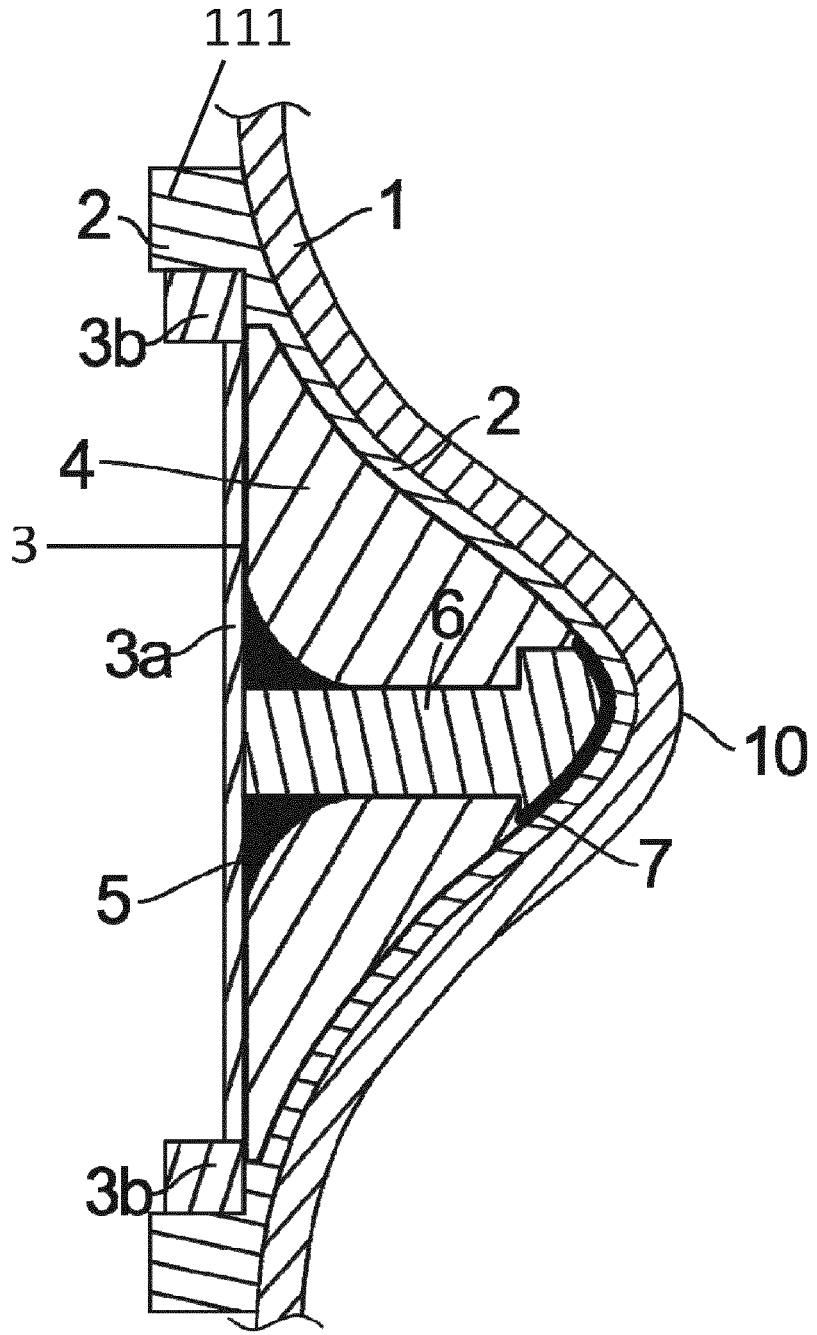
Figure 4:
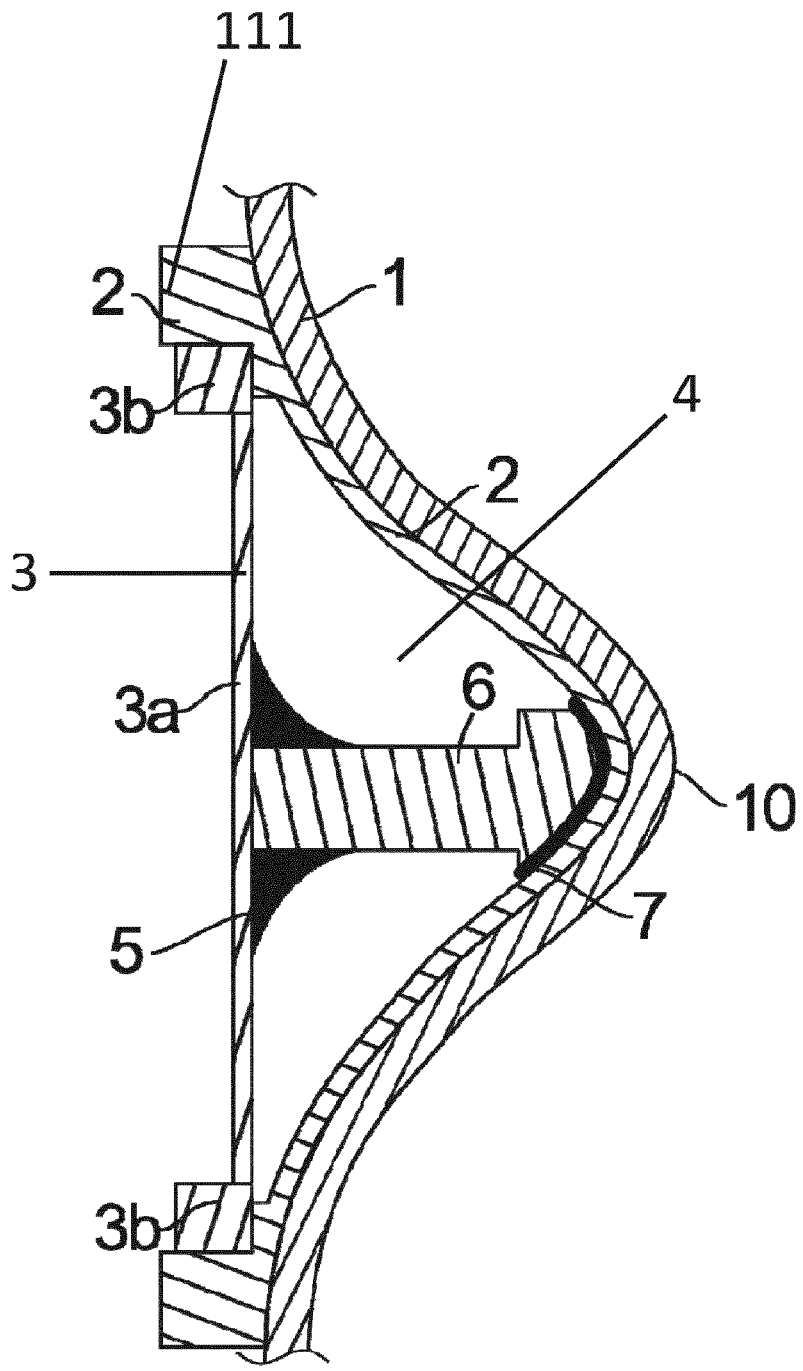
Figure 5:
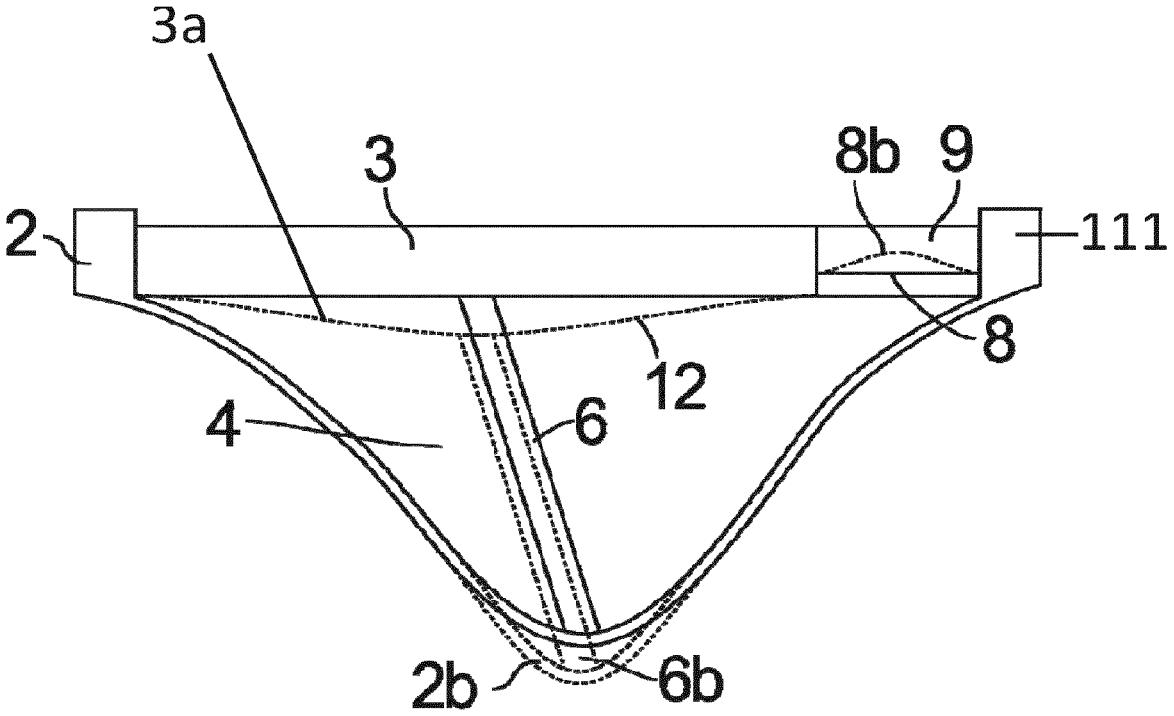
Figure 6A:
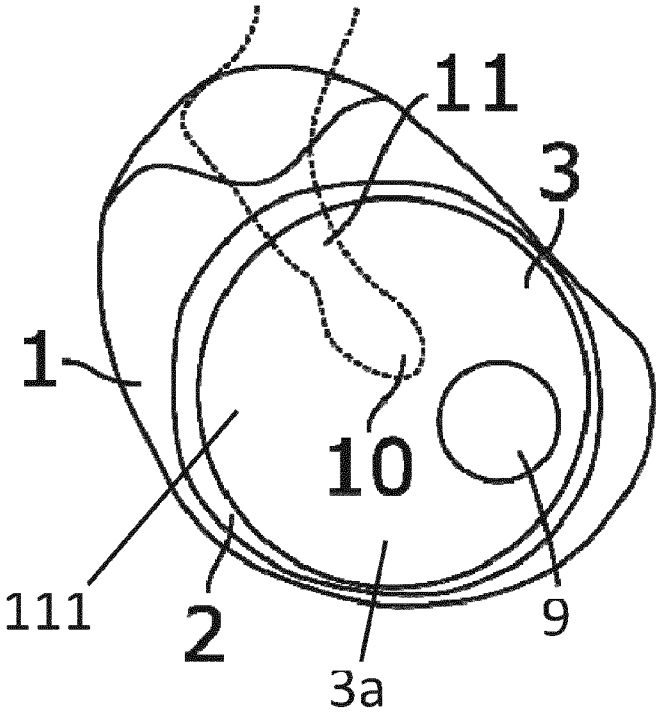
Figure 6B:
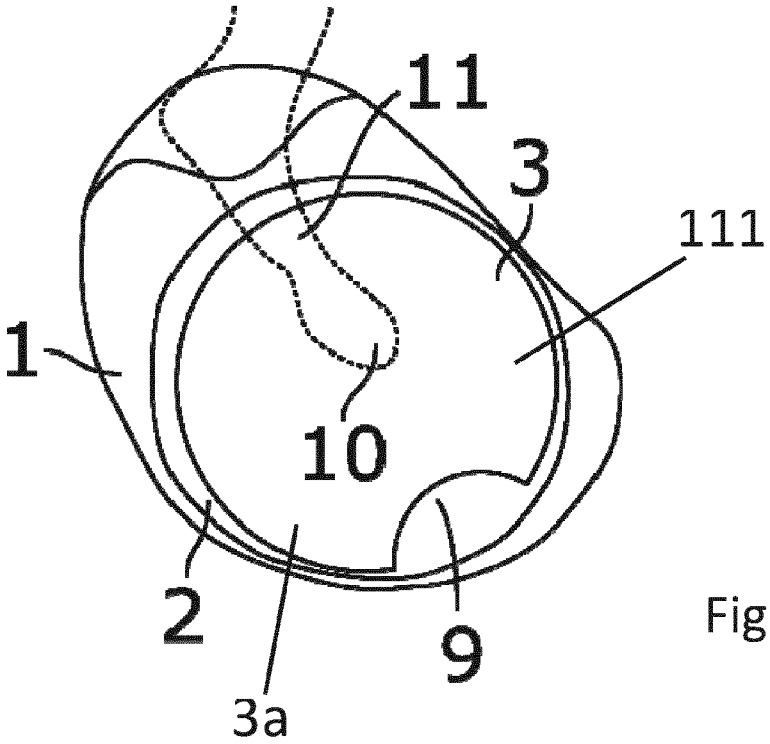
Figure 7:
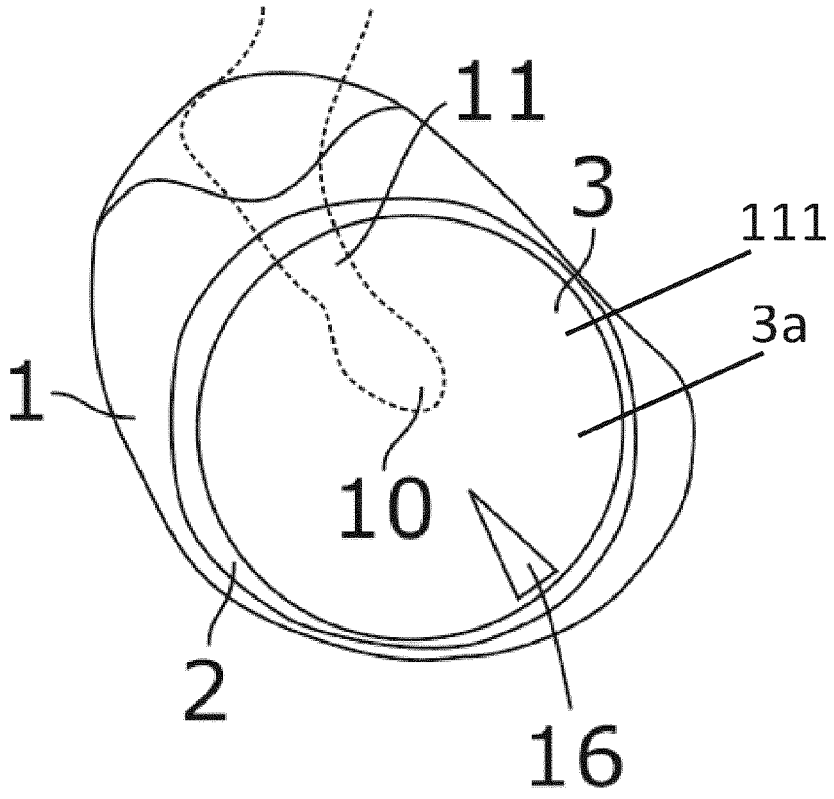

FIG. 1 an example of a vibration module according to the invention,

FIG. 2 a further example of a vibration module according to the invention,

FIG. 3 a further example of a vibration module according to the invention,

FIG. 4 a further example of a vibration module according to the invention,

FIG. 5 a further example of a vibration module according to the invention,

FIG. 6 two examples of vibration modules according to the invention in a top view, and FIG. 7 a further example of a vibration module according to the invention in a top view.

Figure 8:
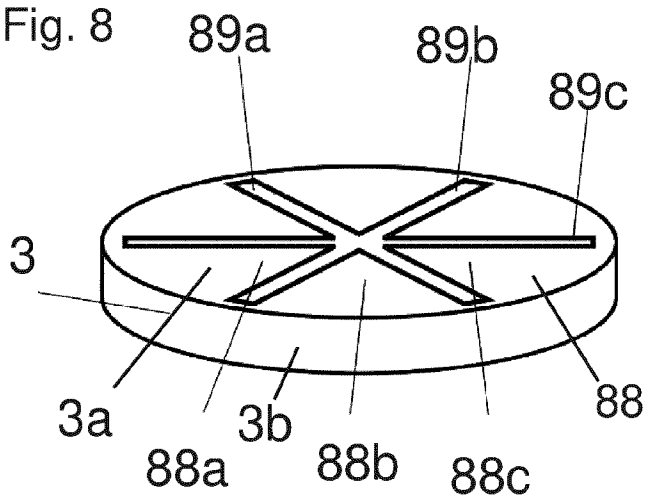

FIG. 8 a top view of an exemplary sound transducer with a segmented membrane surface.

FIG. 1 shows a vibration module 111 according to the invention, which is arranged on an eardrum 1. In the example shown, a narrow gap 14 is formed between the vibration module 111 and the eardrum 1, in which gap 14 a layer for improving the adhesion of the vibration module 111 to the eardrum 1 can be provided. This adhesive layer can be regarded as part of the eardrum module 111. It can, for example, comprise or consist of white oil, fat, silicone oil, glycerine, paraffin or comparable materials.

The eardrum module 111 has, on the one hand, a flat sound transducer 3 and an eardrum contact mold 2 for contacting the eardrum 1. In the example shown, the flat sound transducer 3 and the eardrum contact mold 2 enclose an inner volume 4.

The flat sound transducer 3 has, as part of its surface, a membrane structure 3*a*, which can have a carrier layer and at least one piezoelectric layer arranged on the carrier layer, wherein the piezoelectric layer comprises at least one piezoelectric material. For example, a voltage can be applied to the membrane structure 3*a* via two wires 15*a* and 15*b*, by means of which voltage the membrane structure 3*a* can be excited to vibrate at least in sections. Possible preferred but not necessary embodiments of the wires are bonding wires or flexible printed circuit boards with an electrically conductive component based on gold, platinum, copper, aluminum, iridium or a combination of these materials. For electrical insulation, these can be surrounded with an electrically insulating material such as, for example, polyimide, parylene, liquid crystal polymer, silicone or another material.

In the example shown, the eardrum contact mold 2 has a surface facing away from the sound transducer 3, which surface follows that surface of the eardrum 1 facing the ear canal, that is, runs substantially parallel thereto. As a result, the vibration module 111 with this surface of the eardrum contact mold 2 can be placed on the eardrum 1. The eardrum contact mold 2 is connected at its edge to an edge 3*b* of the flat sound transducer 3. In the example shown, the sound transducer 3 and the eardrum contact mold 2 are connected to one another over the entire periphery of their respective edge. The eardrum contact mold 2 is thereby designed so that it is thin like a membrane or film where it lies above the membrane structure 3*a*, so that it substantially only opposes a force in the direction of the surface of this area of the eardrum contact mold, but not forces that act perpendicular to its surface. The thin area of the eardrum contact mold 2 merges monolithically at its edge into a step in the direction of the sound transducer 3, on whose surface facing the sound transducer 3 the edge 3*b* of the sound transducer rests. In the direction of the edge, this step ends at an inner wall of the edge of the eardrum contact mold 2, against which an outer wall of the edge 3*b* of the sound transducer 3 lies. The edge of the eardrum contact mold 2 is dimensioned such that the edge 3*b* of the sound transducer 3 is completely enclosed by this edge of the eardrum contact mold 2. In this way, the sound transducer 3 is enclosed by the eardrum contact mold 2 and is inserted into the corner formed by the inner wall of the edge of the eardrum contact mold 2 and said step. This inner wall and the surface of the step, like the corresponding walls of the edge 3*b* of the sound transducer 3, form a right angle in this example. In the example shown, the inner wall of the edge of the eardrum contact mold 2 projects somewhat in the direction of the ear canal over the edge 3*b* of the sound transducer. The edge 3*b* of the sound transducer 3 projects slightly in the radial direction inward over the surface of the step. These protrusions are features of the example shown, but are not essential, so that this example can also be implemented without these protrusions. Partial enclosing in the edge area of the actuator by the eardrum contact mold is also possible.

That surface of the eardrum contact mold 2 facing the eardrum 1 follows the shape of the surface of the eardrum 1 up to the outermost edge of the eardrum contact mold 2. In this way, the vibration module 111 can rest completely on the eardrum 1, possibly via a mediating or adhesive layer in the gap 14.

In the example shown, the edge 3*b* of the sound transducer 3 has a thickness greater in the direction perpendicular to the surface of the sound transducer 3 than the membrane structure 3*a*. As a result, the edge 3*b* can stabilize the sound transducer 3.

In the example shown in FIG. 1, the inner space 4 is completely filled with a vibration transmission material, via which vibrations of the membrane structure 3*a* can be transmitted to the eardrum contact mold 2. The rigidity of the vibration transmission material can advantageously be inhomogeneous, so that an area with increased rigidity of, for example, greater than or equal to 100 kN/m is present in the inner volume 4.

In the example shown, the shape of the eardrum contact mold 2 is determined by the shape of the eardrum 1. The surface of the eardrum 1 facing the ear canal is at the greatest distance on the umbo 10 from an imaginary flat surface spanned by the edge of the eardrum. In the example shown, that surface of the eardrum contact mold 2 facing the eardrum 1 is therefore at the greatest distance from the surface of the membrane structure 3*a* on the umbo 10.

FIG. 2 shows a further example of a vibration module 111 according to the invention, which here rests directly on the eardrum 1. The eardrum contact mold 2 and the sound transducer 3 are designed as described in FIG. 1, so that reference should be made to the explanations there. In the example shown in FIG. 2, a vibration transmission element 6, here in the form of a tappet 6, is arranged in the inner volume 4, extending in an elongated manner from the membrane structure 3*a* to a surface of the eardrum contact mold 2 facing the sound transducer 3 and, on one side, is connected to or lies against the membrane structure 3*a* and with its opposite side is connected to or lies against the eardrum contact mold 2. The vibration transmission element preferably adjoins that point on the membrane structure 3*a* where it vibrates with maximum deflection when the voltage is applied. On the part of the eardrum contact mold 2, it is advantageous if the vibration transmission element 6 adjoins the eardrum contact mold 2 in an area which lies above the umbo 10. In all embodiments, it is preferred if the vibration transmission element 6 has a rigidity which is greater than that of the umbo of 1,200 N/m. The vibration transmission element preferably has a rigidity of greater than or equal to 10 kN/m, particularly preferably greater than or equal to 100 kN/m.

The tappet 6 can have a length in the direction perpendicular to the sound transducer 3 of, for example, between 0.5 mm and 4 mm. A diameter of the tappet 6 is preferably less than a diameter of the membrane structure 3*a* and particularly advantageously less than or equal to 2 mm and/or greater than or equal to 0.5 mm.

In the example shown in FIG. 2, that area of the inner volume 4 in which the vibration transmission element 6 is not present is filled with a soft, elastic material. This soft material can have a significantly lower modulus of elasticity than the vibration transmission element 6. In the example shown in FIG. 2, the vibration transmission element 6 extends to just before the inner surface of the eardrum contact mold 2, so that there is a gap between that surface of the vibration transmission element 6 facing the eardrum contact mold 2 and the inner surface of the eardrum contact mold 2, in which gap the soft material can be present.

The rigidity of the vibration transmission element 6 is preferably at least 10 times greater than the rigidity of the soft material.

In the example shown, the vibration transmission element 6 is initially cylindrical in shape, starting from the membrane structure 3*a*, and then widens in the direction of the eardrum contact mold before its end. As a result, that surface of the vibration transmission element 6 facing the eardrum contact mold 2 is larger than a cross section of the vibration transmission element 6 in the area facing the sound transducer 3. The shape of that surface of the vibration transmission element 6 facing the eardrum contact mold 2 follows the shape of the inner surface of the eardrum contact mold 2 in that area which is opposite the surface of the vibration transmission element 6.

FIG. 3 shows a further example of a vibration module according to the invention. The example shown in FIG. 3 is designed like that shown in FIG. 2, with the following differences. In FIG. 2, the vibration transmission element 6 adjoins the membrane structure 3*a* with an area of constant cross-sectional surface. In contrast to this, in FIG. 3, the cross-sectional surface of the vibration transmission element 6 expands, starting from an area of constant cross section, in the direction of the membrane structure 3*a*, in order to adjoin there with a maximum surface. The expansion can be brought about, for example, in that the vibration transmission element 6, in its configuration as shown in FIG. 2, is embedded in a material lying on the membrane structure 3*a*, which material surrounds the vibration transmission element 6.

In the example shown in FIG. 2, there was a narrow distance between that surface of the vibration transmission element 6 facing the eardrum contact mold 2 and the inner surface of the eardrum contact mold 2. In the example shown in FIG. 3, this gap is filled with a material 7 which can also be regarded as part of the vibration transmission element 6. In this case, the configured vibration transmission element 6 shown in FIG. 2 adjoins the eardrum contact mold 2 via the material 7.

The materials 5 and 7 can, for example, comprise or be an adhesive for connecting the vibration transmission element to the sound transducer or the eardrum contact mold, e.g., silicone, epoxy resin, cyanoacrylate and/or rubber.

That area of the inner volume 4 not filled by the vibration transmission element 6 and the materials 5 and 7 is in turn filled with a soft material, as shown in FIG. 2. The sound transducer 3 and the eardrum contact mold 2 are also designed here as shown in FIG. 2.

FIG. 4 shows a further example of a vibration module according to the invention. Apart from the following differences, the vibration module 111 shown in FIG. 4 is designed like that shown in FIG. 3.

While in FIG. 3, the inner volume 4 is there filled with a soft material where the vibration transmission element 6 and the materials 5 and 7 are not present; in FIG. 4, this area of the inner volume 4 is empty or filled with air.

The vibration transmission element 6, the sound transducer 3 and the eardrum contact mold 2 are configured as shown in FIG. 2, so that reference should be made to the description there. The materials 5 and 7 are designed in FIG. 4 as shown in FIG. 3, so that reference should be made to the description of FIG. 3.

FIG. 5 shows a further example of a vibration module 111 according to the invention. In the example shown in FIG. 5, the eardrum contact mold 2 has an edge adjoining the thin or membrane-shaped area of the eardrum contact mold 2 with a straight inner wall. The sound transducer 3 with its outer edge lies against this inner wall of the eardrum contact mold 2 and is inserted up to the membrane-shaped area of the eardrum contact mold 2 in an opening surrounded by the edge of the eardrum contact mold 2.

A vibration transmission element 6 is in turn arranged between the sound transducer 3 and the membrane-shaped section of the eardrum contact mold 2, which vibration transmission element 6 runs from a point of maximum deflection of the membrane structure 3*a* to a point of the eardrum contact mold 2, which is arranged above the umbo when the vibration module is arranged as intended on an eardrum 1. In the example shown, the inner volume 4 is filled with a soft, substantially incompressible material. If the membrane structure 3*a* is now deflected into a deflected position, which is identified by 12, in the course of the vibration, the membrane structure 3*a* displaces the incompressible material. In the example shown in FIG. 5, the vibration module 111 has an opening 9 in the surface of the sound transducer 3, into which the incompressible material can be displaced.

FIG. 5 shows a superposition of two phases of the vibration of the membrane structure 3*a*. In the following, the first phase is to be referred to as that phase in which the membrane structure 3*a* is undeflected, i.e., flat, and the second phase is that phase in which the membrane structure 3*a* has the shape marked 12, which is to be regarded here as the maximum deflection.

It can be seen that in the second phase, the vibration transmission element 6 is shifted into the position 6*b* and thereby converts the eardrum contact mold 2 into the shape 2*b*, which thereby acts on the eardrum 1. At the same time, the incompressible material is displaced and therefore has an outwardly curved surface 8*b* in the area of the opening 9. In contrast, in the undeflected state of the membrane structure 3*a*, the surface of the material 8 is planar.

The volume swept over by the membrane structure 3*a* between the undeflected and deflected state 12 normally differs from the volume swept over by the eardrum contact mold 2 between the undeflected and deflected state 2*b*. The incompressible filling material in the inner volume 4 is therefore partially displaced into the opening 9 and leads to a surface deformation of the filling material at the opening 9.

In the examples shown in FIGS. 2, 3 and 4, the vibration transmission element 6 was substantially perpendicular to an area in or near the center of the membrane structure 3*a*, since the center of the membrane structure 3*a* in these configurations lies substantially directly below the umbo 10. Through the opening 9 provided in the example shown in FIG. 5, the location of maximum deflection of the membrane structure 3*a* can shift away from the center of the opening formed by the edge of the eardrum contact mold 2 under certain circumstances. This is shown in FIG. 5. If the vibration transmission element 6 is also to adjoin the membrane structure 3*a* in the area of maximum deflection here, the longitudinal direction of the vibration transmission element 6 is at an angle not equal to 90° to the plane in which the membrane structure 3*a* extends.

FIG. 6 shows, in sub-figures A and B, two top views of the embodiment of a vibration module according to the invention shown in FIG. 5, but with differently positioned openings 9.

It can be seen that the vibration module 111 and the eardrum contact mold 2 and the sound transducer 3 have a substantially circular periphery. The maleus 11 is shown in dotted lines since it cannot actually be seen in the top view shown, but is shown here for orientation. In the example shown in FIG. 6A, the opening 9 is circular in design and lies completely within the surface of the membrane structure of the sound transducer 3. The edge of the opening 9 is thus formed over its entire length by the membrane structure 3*a*.

In the example shown in FIG. 6B, the opening 9 is designed as a recess in the edge of the membrane structure 3*a* of the sound transducer 3. Part of the edge of the opening 9 is thus formed by the membrane structure 3*a*, while another part of the edge of the opening is formed by the edge of the eardrum contact mold 2. The opening could also be formed by an edge deviating from the circular shape.

FIG. 7 shows another exemplary vibration module 111 in accordance with the present invention. Again, a top view of the surface of the membrane structure 3*a* of the sound transducer 3 is shown. The maleus 11 is again drawn in dashed lines here, since it cannot actually be seen in this top view. The sound transducer 111 is arranged on the eardrum 1 in the example shown. In many embodiments of the invention, it is advantageous or necessary to arrange the vibration module on the eardrum 1 in the correct orientation about an axis that is perpendicular to the membrane structure 3*a*. In order to simplify this alignment, it is advantageous if at least one marking 16 is provided on that surface of the sound transducer 3 facing away from the eardrum contact mold 2, which marking 16 can point, for example, in the direction of the longitudinal axis of the maleus 11. The malleus often appears through the opaque eardrum or pushes itself through it and is reflected in the surface shape and is therefore usually recognizable through the ear canal.

FIG. 8 shows an example of a sound transducer 3, as may be used in the vibration module 111 according to the invention.

In the example shown, sound transducer 3 has a circular periphery. In general, the peripheral shape of sound transducer 3 is preferably identical to the peripheral shape of the eardrum contact mold 2. In the example shown in FIG. 8, the sound transducer 3 has a membrane structure 3*a* which is delimited by a circular edge 3*b*.

The membrane structure 3*a* is thereby divided by cut lines 89*a*, 89*b*, and 89*c* into segments 88*a*, 88*b*, and 88*c*, among other things. The cut lines 89*a*, 89*b*, and 89*c* are thereby configured so that they sever all layers of membrane structure 3*a*. The segments 88*a*, 88*b*, and 88*c* are thus mechanically decoupled at cut lines 89*a*, 89*b*, and 89*c*. The segments 88*a*, 88*b*, and 88*c* are permanently arranged on the edge at their outer edges. The segments 88*a*, 88*b*, and 88*c* thus have a pie wedge shape and are deflectable at their points.

The membrane structure 3*a* may thereby have a carrier layer and at least one piezoelectric layer arranged on the carrier layer and having at least one piezoelectric material, such that vibrations of the membrane structure 3*a* are generatable by applying a voltage to the piezoelectric layer.

In the example shown in FIG. 8, the segments 88*a*, 88*b* and 88*c* therefore vibrate with their points facing the center of the circular shape due to the application of such a voltage, among other things.

The membrane structure of sound transducer 3 is divided, in the example shown, into six segments, like segments 88*a*, 88*b*, and 88*c* by way of example, in the surface of the membrane structure 3*a* by cut lines 89*a*, 89*b*, 89*c*, which sever all layers of the membrane structure 3*a*, such that the membrane structure is mechanically decoupled at cut lines 89*a*, 89*b*, 89*c*. In the example shown, the cut lines run radially to a center point of sound transducer 3 and meet at the center point, such that all segments are mechanically decoupled at the center point, like segments 88*a*, 88*b*, and 88*c* by way of example. Reference is explicitly made to the fact that the number of segments, like segments 88*a*, 88*b*, and 88*c* by way of example, the number of cut lines 89*a*, 89*b*, 89*c*, and also the shape of cut lines 89*a*, 89*b*, 89*c* and segments, like segments 88*a*, 88*b*, and 88*c* by way of example, may be realized in multiple other ways. For example, spiral shaped cut lines are also possible.

The invention claimed is:

1. A vibration module for placing on an eardrum, the vibration module comprising:

a flat sound transducer, wherein the flat sound transducer includes a membrane structure located on a surface of the flat sound transducer, wherein the membrane structure includes at least one carrier layer and at least one piezoelectric layer located on the at least one carrier layer, the at least one piezoelectric layer including at least one piezoelectric material, and wherein the flat sound transducer is configured to vibrate, at least in sections, by applying an electrical voltage to the at least one piezoelectric layer; and an eardrum contact mold configured to contact the eardrum.

2. The vibration module according to claim 1, wherein the flat sound transducer and the eardrum contact mold together enclose an inner volume.

3. The vibration module according to claim 1, wherein the membrane structure is divided in the surface by at least one cut line severing all layers of the membrane structure into at least one, two, or more segments, such that the membrane structure is mechanically decoupled at the at least one cut line.

4. The vibration module according to claim 1, wherein the eardrum contact mold is connected at an edge of the eardrum contact mold to an edge of the flat sound transducer, at least in sections.

5. The vibration module according to claim 1, wherein the flat sound transducer includes at least one of a membrane or the membrane structure and includes a rigid edge surrounding the membrane or the membrane structure, and wherein the eardrum contact mold is connected to the rigid edge of the flat sound transducer on at least part of the rigid edge of the flat sound transducer.

6. The vibration module according to claim 1, wherein at least one of the flat sound transducer or the eardrum contact mold has a smallest diameter less than a smallest diameter of the eardrum, and/or wherein at least one of the flat sound transducer or the eardrum contact mold has a largest diameter less than the largest diameter of the eardrum, wherein at least one of the largest diameter of the flat sound transducer and/or the eardrum contact mold is less than or equal to 12 mm or the smallest diameter of the flat sound transducer and/or the eardrum contact mold is greater than or equal to 3 mm.

7. The vibration module according to claim 2, further comprising:

a vibration transmission element connected to or in contact with at least one location on a surface of the flat sound transducer and at least one location on a surface of the eardrum contact mold, wherein the vibration transmission element fills at least a portion of the inner volume.

8. The vibration module according to claim 2 wherein the inner volume is partially or completely filled with a vibration transmission material.

9. The vibration module according to claim 8, wherein at least one of: the flat sound transducer includes a recess or the eardrum contact mold includes a recess in a surface, and wherein at least one of, the recess included in the flat sound transducer or the recess included in the surface of the eardrum contact mold is arranged such that the vibration transmission material is displaced into at least one of, the recess included in the flat sound transducer or the recess included in the surface of the eardrum contact mold.

10. The vibration module according to claim 2, wherein a vibration transmission element is formed in the inner volume as a partial area of a vibration transmission material, in which the vibration transmission material has a rigidity greater than or equal to 1000 N/m.

11. The vibration module according to claim 7, wherein the vibration transmission element extends from a point of maximum deflection of the flat sound transducer to a point of the eardrum contact mold, which, when the vibration module is arranged as intended on the eardrum, lies at a distance of less than 5 mm from at least one of an umbo or a malleus of the eardrum.

12. The vibration module according to claim 1, wherein the eardrum contact mold has a surface facing away from the flat sound transducer, which surface has a shape of a surface of the eardrum facing an ear canal or adapts to the surface of the eardrum facing the ear canal.

13. The vibration module according to claim 1, wherein the eardrum contact mold, in an area which makes contact with the eardrum when used as intended, has a thickness that is less than or equal to 500 μm, and forms a tension in a direction parallel to a surface of the eardrum contact mold in the area.

14. The vibration module according to claim 1, wherein the eardrum contact mold includes a silicone.

15. The vibration module according to claim 1, further comprising:

a layer located on a surface of the eardrum contact mold facing away from the flat sound transducer to improve adhesion to the eardrum, wherein the layer comprises at least one of, a white oil, fat, a silicone oil, glycerine, or paraffin.

16. The vibration module according to claim 1, wherein a minimum distance between the flat sound transducer and a surface of the eardrum contact mold facing away from the flat sound transducer is less than or equal to 1 mm.

17. The vibration module according to claim 1, wherein the flat sound transducer is cast into the eardrum contact mold at an edge or wherein the flat sound transducer is glued into a recess in the eardrum contact mold, and wherein the recess extends along or surrounds the edge of the eardrum contact mold.

18. A vibration module for placing on an eardrum, comprising:

a flat sound transducer, wherein the flat sound transducer includes a membrane structure located on a surface of the flat sound transducer, wherein the membrane structure includes at least one carrier layer and at least one piezoelectric layer located on the at least one carrier layer, wherein the at least one piezoelectric layer includes at least one piezoelectric material, and wherein the flat sound transducer is configured to vibrate, at least in sections, by applying an electrical voltage to the at least one piezoelectric layer;

an eardrum contact mold configured to contact the eardrum; and a layer located on a surface of the eardrum contact mold facing away from the flat sound transducer to improve adhesion to the eardrum, wherein the layer comprises at least one of: a white oil, fat, a silicon oil, glycerine, or paraffin.

19. A vibration module for placing on an eardrum, the vibration module comprising:

a flat sound transducer; and an eardrum contact mold configured to contact the eardrum, wherein the flat sound transducer includes at least one of a membrane or a membrane structure and includes a rigid edge surrounding the membrane or the membrane structure, and wherein the eardrum contact mold is connected to the rigid edge of the flat sound transducer on at least part of the rigid edge of the flat sound transducer.

20. A vibration module for placing on an eardrum, the vibration module comprising:

a flat sound transducer; and an eardrum contact mold configured to contact the eardrum, wherein the eardrum contact mold, in an area which makes contact with the eardrum when used as intended, has a thickness that is less than or equal to 500 μm.

21. The vibration module of claim 20, wherein the eardrum contact mold forms a tension in a direction parallel to a surface of the eardrum contact mold in the area.

22. A vibration module for placing on an eardrum, the vibration module comprising:

a flat sound transducer; and an eardrum contact mold configured to contact the eardrum, wherein the flat sound transducer is cast into the eardrum contact mold at an edge or wherein the flat sound transducer is glued into a recess in the eardrum contact mold, and wherein the recess extends along or surrounds the edge of the eardrum contact mold.

* * * * *